US007032711B1

(12) United States Patent
Katz et al.

(10) Patent No.: US 7,032,711 B1
(45) Date of Patent: Apr. 25, 2006

(54) ACCESSORY TRAY FOR STEPLADDERS

(75) Inventors: Gary Katz, Mesa, AZ (US); Marvin Teutsch, Phoenix, AZ (US)

(73) Assignee: Ladder Mate Corporation, Mesa, AZ (US)

( * ) Notice: Subject to any disclaimer, the term of this patent is extended or adjusted under 35 U.S.C. 154(b) by 224 days.

(21) Appl. No.: 10/696,027

(22) Filed: Oct. 28, 2003

(51) Int. Cl.
*E04G 1/00* (2006.01)
*E04G 3/08* (2006.01)
*B65D 85/28* (2006.01)

(52) U.S. Cl. ..... 182/129; 248/238; 206/373; 206/372

(58) Field of Classification Search ..... 182/129, 182/121, 230; 248/210, 238; 206/372, 373, 206/370
See application file for complete search history.

(56) References Cited

U.S. PATENT DOCUMENTS 2,470,053 A 5/1949 Salisbury
2,957,542 A 10/1960 Rizzuto
3,422,923 A 1/1969 Lund
3,637,046 A 1/1972 Emmons
3,842,936 A 10/1974 DeLuca
4,121,692 A 10/1978 Morawski
4,236,599 A 12/1980 Luff et al.
4,261,435 A 4/1981 Winter
4,276,955 A 7/1981 Hickman
4,303,158 A * 12/1981 Perkins ..... 206/373
4,418,793 A 12/1983 Brent
4,569,449 A 2/1986 Brent
4,653,713 A 3/1987 Hamilton
4,979,590 A 12/1990 Bailey
5,054,668 A * 10/1991 Ricchiuti ..... 206/818
5,195,538 A * 3/1993 Eldridge, Jr. et al. ..... 206/370
5,333,823 A 8/1994 Joseph
5,505,302 A 4/1996 Ferley
5,505,354 A * 4/1996 Hutton et al. ..... 206/315.11
5,573,081 A 11/1996 Bartnicki et al.
5,603,405 A 2/1997 Smith
5,813,530 A 9/1998 Kornblatt
5,873,433 A 2/1999 Katz
5,882,097 A 3/1999 Kohagen et al.
5,913,380 A 6/1999 Gugel et al.
5,941,344 A 8/1999 Spadaro
5,971,102 A 10/1999 Brown
6,267,238 B1 7/2001 Miller et al.
6,443,260 B1 9/2002 Katz et al.
6,859,980 B1 * 3/2005 Baer ..... 16/354

* cited by examiner

*Primary Examiner*—Hugh B. Thompson, II
(74) *Attorney, Agent, or Firm*—Gregory J. Nelson

(57) ABSTRACT

A tool and hardware accessory having base securable to the top cap of a ladder at clamps which are designed to provide universal mounting to most ladder caps. A tray is pivotally mounted to the accessory base at hinge sections and when deployed extends forwardly and slightly upwardly to accommodate weighty items, such as paint cans, without being depressed below a generally horizontal position. The tray has compartments for hardware items and may include removable organizer containers for small parts. A magnetic element, such as a flexible magnetic pad, may be provided to retain small parts.

11 Claims, 6 Drawing Sheets

78
73
TC 175
185
184
181
186
183
180
30
108
182
208
36
212
152
71
150
42
166
214
34
162
164
40
188
234
45
152
154
238
236
73
72
210
5
156
43
110
51
106
14
43
32
44

18
L
12
40
53
51
50
58
56
60
55
54
43
57

4
TC
60
43
50
4

TC
57
54
43
50

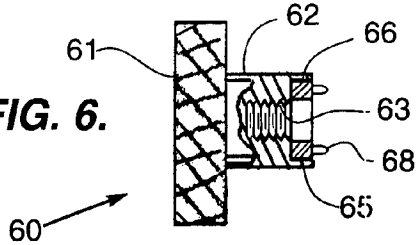
FIG. 6.
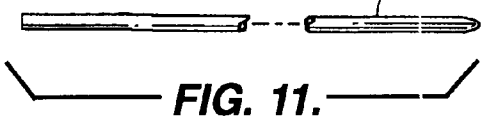
FIG. 11.
FIG. 10.
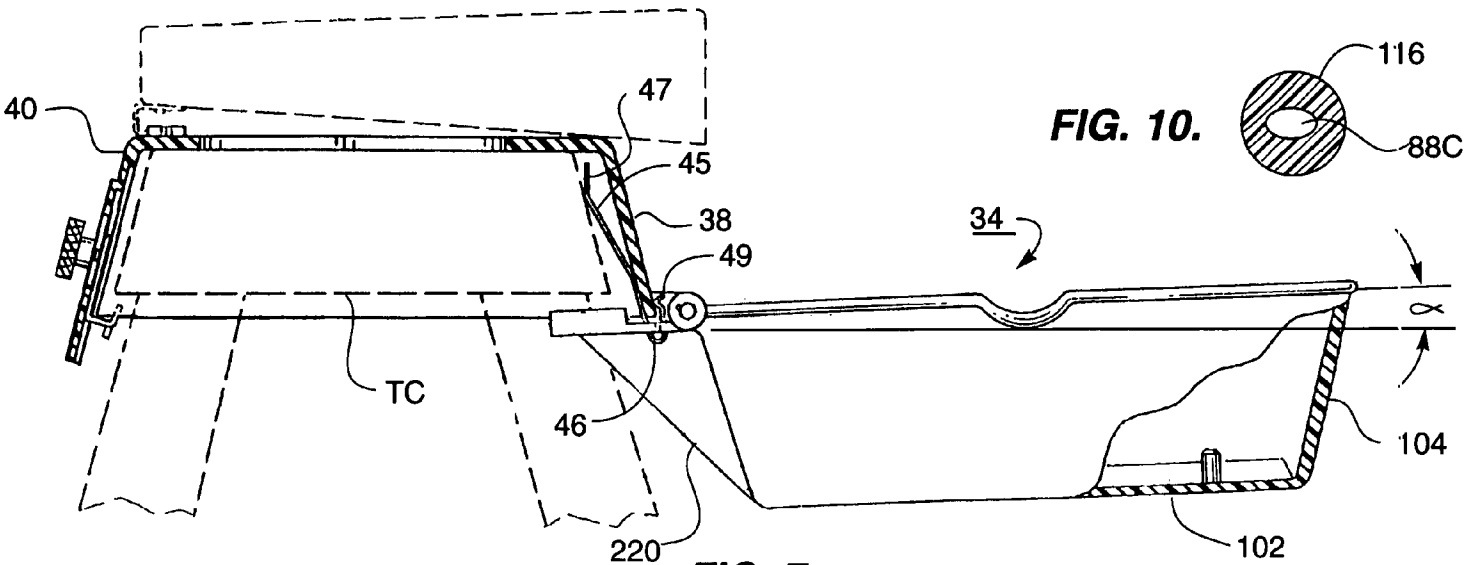
FIG. 7.
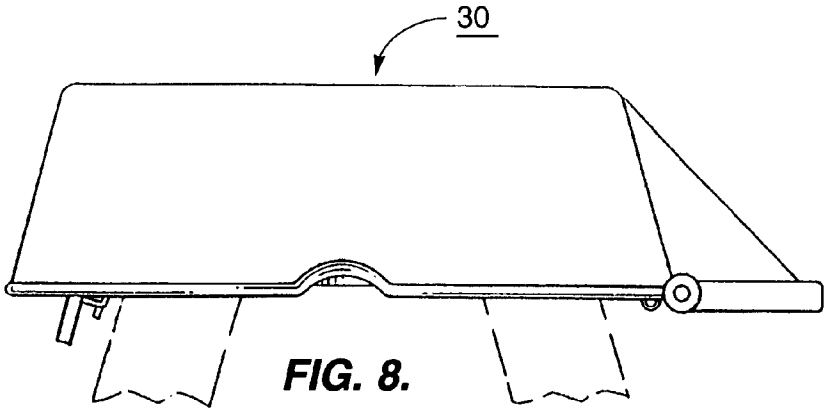
FIG. 8.

ACCESSORY TRAY FOR STEPLADDERS

FIELD OF THE INVENTION

The present invention relates to an accessory for a stepladder and, more particularly, relates to a storage device which is securable to the top cap of a ladder to receive and temporarily store hardware, parts, paint containers and other items.

BACKGROUND OF THE INVENTION

When working from a stepladder, it is convenient for the worker to have tools, paint cans, nails, hardware and other items required for tasks readily accessible in a location where they can be stored for convenient retrieval. In recognition of this need, there are various types of accessory devices available in the prior art which devices may be a part of a ladder. The most common device of this type is the conventional foldable tray or platform extendable from the front support legs of a ladder and which tray may be pivoted to an out-of-the-way position when not in use. Other ladder trays or article holders attachable to a ladder can be found in the prior art.

One such device is an accessory tray designated the Flip Tray® device. The Flip Tray device is the subject of prior U.S. Pat. Nos. 5,873,433 and 6,443,260. The Flip Tray device is an accessory securable to the top cap of a stepladder for temporary storage of tools, parts and the like. This accessory includes a support securable to the top cap by various clamping arrangements which may include bolts, springs or tie-downs. A tray member is pivotally secured to the support and in a deployed position extends horizontally forwardly from the ladder. In the folded or stored position, the tray member is overlying registry with the top cap of the ladder. The support is adjustable to accommodate stepladder caps of varying dimensions.

The present invention represents improvements to the Flip Tray stepladder accessory tray described above. Accordingly, it is a primary object of the present invention to provide an article-receiving tray attachable to a stepladder which provides the user with a convenient receptacle for tools, paint, hardware and other articles, which tray is particularly convenient to use and assemble.

Another object of the present invention is to provide a ladder tray which has universal mountings so that it may be easily and conveniently secured to most conventional stepladders.

Another object of the present invention is to provide a ladder tray that can be fabricated from various materials and particularly plastic and is of a design that lends itself to injection molding technology and which may be easily and conveniently assembled.

Another object of the present invention is to provide a ladder tray which is compartmented for the organized storage of various hardware items such as nails, screws and similar small items.

BRIEF SUMMARY OF THE INVENTION

Briefly, the present invention provides a ladder accessory which has a base which is securable to the top cap of a stepladder and a tray which is pivotally mounted on the base. The tray is mounted so that when it is deployed without contents, it is canted upwardly so that the weight of heavier items, such as paint cans, will not cause the tray to be depressed below a horizontal position. The base is secured to the ladder cap by attachments which may include fasteners, springs or clamps. The clamps are vertically adjustable along an edge of the base to engage an edge of the ladder cap. The clamps are designed so that they are reversibly positionable on the ladder cap to provide a universal mounting feature adaptable to various ladder cap configurations.

The forward edge of the base extends along the forward edge of the ladder cap and carries hinge sections. The tray has complimentary hinge sections and a hinge pin extends through the hinge sections of the base and tray when in registry so the tray may be pivoted between the stored and deployed positions. The hinge sections are in the form of barrels and at least one barrel is configured so that it will receive the hinge pin in a press-fit for convenience of assembly.

When the tray is in a deployed or use position, the tray extends forwardly generally tilted or canted upwardly a few degrees. A flange at the opposite sides of the tray abuts an edge of the base to stabilize the tray in the deployed position and serves to transfer the weight of the load imposed on the tray to the base and the ladder top cap.

The tray assembly is dimensioned to accommodate hardware items such as screws and nails, and preferably includes compartments for the containment of items of this type. The compartments may be provided with flexible magnet sections to retain loose hardware items such as nails and screws. The tray is also provided with circular retainer rings for paint cans of various sizes. The opposite sidewalls of the tray may be grooved to receive elongate items such as pipes and fluorescent light tubes. The tray may be further provided with removable organizer containers which can be inserted into the tray when necessary. For example, screws and nails of certain sizes can be stored in these organizers and, when required, the organizers can be removed from a storage location and positioned in the tray in an accessible position.

When not in use, the tray may be folded to a stored position in which the bottom of the tray overlies the base in a nested position so that the tray is out-of-the-way and does not interfere with the storage and use of the ladder.

BRIEF DESCRIPTION OF THE DRAWINGS

The above and other objects and advantages will become more readily apparent from the following description, claims and drawings in which:

FIG. 6 is a detail view, in partial cross-section, of the nut associated with the clamp as seen in FIGS. 1, 2, 3 and 4;

FIG. 7 is a side view of the tray shown in FIG. 1 in a deployed position with the tray canted upwardly;

FIG. 8 is a side view of the tray assembly of the present invention positioned on the top cap and shown in a stored position;

FIG. 10 is a cross-sectional view of a hinge barrel taken along line 10—10 of FIG. 9 showing the configuration of an end hinge barrel on the tray;

FIG. 11 is a detail view of the hinge pin with a chamfered end;

DETAILED DESCRIPTION OF THE DRAWINGS

Figures 1, 2, 3, 4, 5:
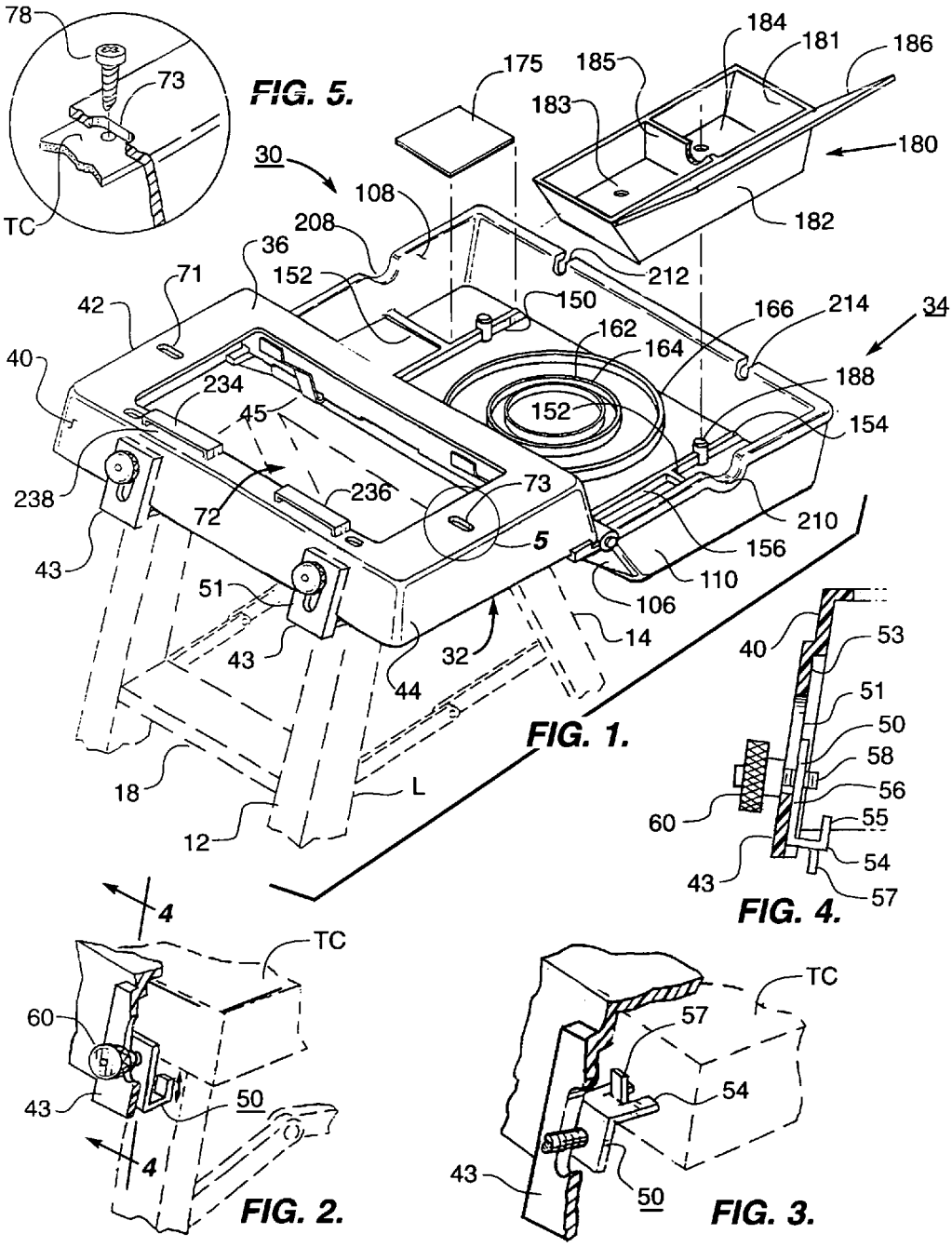
FIG. 1 is a perspective view of the top portion of a stepladder which is shown in dotted lines with the tray assembly of the present invention shown positioned on the top cap of a ladder with the tray shown in a deployed position.
FIG. 2 is a detail view of one of the clamp assemblies in a first clamping position.
FIG. 3 is a detail view of the clamp assembly as shown in FIG. 2 in a reversed, second clamping position.
FIG. 4 is a sectional view taken along line 4—4 of FIG. 2.
FIG. 5 is a detail view as indicated in FIG. 1 showing attachment of the tray to a ladder cap by use of a fastener.

Turning now to the drawings, a conventional ladder L is shown having two pairs of legs 12 and 14. As is conventional, the legs are secured to a ladder cap at their upper ends and legs 14 are pivotally secured to the cap so the ladder may be folded to a compact condition for convenience of storage when not in use. The ladder is provided with a plurality of rungs or steps 18 extending between legs 12. The number of steps or rungs depends upon the height of the ladder, one step 18 being shown as representative.

The top cap TC of the ladder has a generally rectangular, planar upper surface and may have depending sides and ends. The cap TC may be of various dimensions depending upon the specifications of the particular manufacturer. Good safety practice cautions that the top cap should not be used as a support surface on which the user stands. Therefore, the top cap provides a convenient location for the attachment of storage device 30 of the present invention.

The ladder tray assembly includes a base 32 and a tray 34. The base 32 is shown as having a generally rectangular top surface 36, front wall 38, rear wall 40 and opposite sidewalls 42 and 44. The front and rear walls 38, 40 diverge slightly outwardly as best seen in FIG. 7. The base 32 preferably is fabricated from a suitable plastic by injection molding, although metal and fiberglass are also acceptable materials.

The rear wall 40 is provided with spaced-apart, raised tabs 43 of increased thickness and extending below the lower edge of wall 40. The inner surface of wall 40 opposite the tabs define recesses 53 and slots 51 extend through the tabs into the recesses, as best seen in FIG. 4. The recesses 53 are adapted to slidably receive clamps 50 as seen in detail in FIGS. 2, 3 and 4.

The clamps 50 each have a body or strap section 56 which is bent to form a lip 54 which has an upturned end 55 and an opposite extending projection 57. The straps each carry a threaded stud 58 which projects through slot 51 in the wall. Thumb nut 60 is engageable with the stud. The thumb nut 60 is shown in detail in FIG. 6 and has a knurled outer end 61 and a cylindrical body 62 which defines an internally threaded bore 63 which is engageable with the stud 58. The inner end of the cylindrical body 62 is recessed at 65 and receives lock washer 66 which fits in the recess. The outer surface of the lock washer is provided with an annular surface having a plurality of raised projections 68.

The clamps 50 are vertically slidable in their respective recesses 53 and, once adjusted, the lip 54 of the clamp can be engaged with the lower edge of the wall of the stepladder as seen in FIGS. 2 and 7. In these figures, the clamp is oriented with the U-shaped lower edge positioned to engage the lower edge of the ladder when the clamp is moved upwardly. Once the clamp is in the proper position, the knurled nut 60, as seen in detail in FIG. 6, can be tightened. The projections 68 on the lock washer ring at the front of the knurled nut will engage or "bite" into the material surrounding the slot on the tabs on the wall of the ladder cap. This frictional engagement of the lock washer 66 with the surface of the tabs will secure the clamps without the user having to over-tighten the clamps 50 and possibly break the material of the base if it is plastic.

The clamps 50 may also be placed in an inverted position as shown in FIG. 3 to accommodate mounting the tray assembly on certain styles of ladder top caps TC. The elongate tabs 43 provide a full range of vertical adjustment of the clamps without having to unnecessarily deepen or increase the vertical length of the walls of the tray base resulting in a substantial savings in material, as well as reducing the overall size and weight of the ladder tray.

In FIG. 3, the clamp 50 is shown reversed with the lip 54 disposed upwardly and the integrally formed projection 57 extending upwardly along the inner surface of the ladder top cap. The clamp, once in the proper position, is secured by utilizing nut 60, as shown in FIG. 6. The nut is provided with a lock washer 66 along its inner surface which will frictionally engage the material of the plastic tray when tightened to prevent the nut from backing off and reducing the torque requirement for securement of the clamps.

The base 32 is designed having an inner width and length to allow it to be positioned over the top cap of the ladder. As mentioned above, the base is secured by clamps 50 along the edge of the cap so the lower lip 54 engages the lower edge of the top cap in one of their operative positions. The tray base is further held in place against the top cap by one or more springs 45 seen in FIGS. 1 and 7. The springs 45 are formed having a lower U-shaped section 46 which terminates at a retainer section 49. The springs are secured to the lower edge of wall 38 and retained by engage of the retainer section with the lower edge. Spring arm 47 extends along the interior wall 38 and exerts a spring force against the top cap TC as best seen in FIG. 7. The springs are made from a suitable material such as a stainless or spring steel.

To provide lateral adjustment to accommodate top caps of different widths, a pair of slots 71, 73 are provided in the tray base at either side of the central cutout 72. A cutout 72 relieves the weight of the tray assembly and allows the use of tool holding slots and holes provided in the ladder top cap TC. The user may affix the base 32 to the top cap TC by inserting fasteners such as sheet metal screws 78 through slots 71, 73 into an aligned drilled hole in the top cap, as seen in FIG. 5. When the screws are tightened, the tray base will be affixed to the top cap and the tray can be detached by loosening and removing the screws 78. Other types of fasteners such as a bolt with a lock washer and nut may be used.

The tray 34 may be of any convenient shape, but generally for most applications will be rectangular having a bottom wall 102, front wall 104, rear wall 106 and opposite sidewalls 108 and 110. The tray is dimensioned to allow it to be nested in an inverted position overlying the base 32 of the ladder cap when in a stored position as shown in FIG. 8. The tray may be easily deployed to the use position shown in FIG. 7 and pivoted to the stored position for convenience and compactness.

Figure 9:
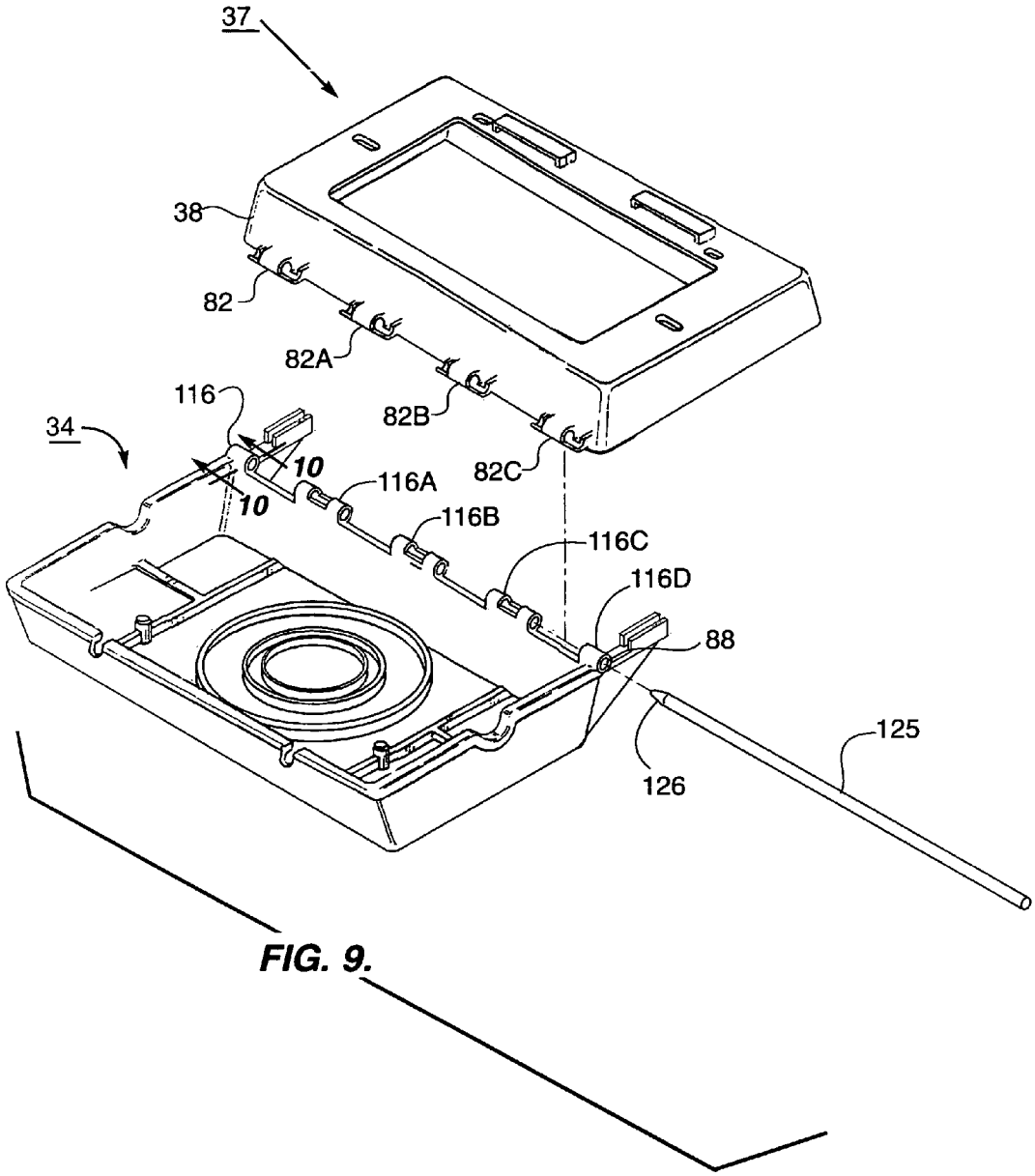
FIG. 9 is an exploded view showing the details of the pivotal connection between the tray and base.

To accommodate folding, wall 38 of the base 34 is provided with a plurality of spaced-apart, integrally formed hinge barrels 82, 82A, 82B and 82C, as best seen in FIG. 9. The hinge barrels each define aligned bores. The rear wall 106 of the tray carries a plurality of hinge barrels 116, 116A, 116B, 116C and 116D, also as seen in FIG. 9. When the hinge barrels of the base and tray are aligned, they define an elongate bore 88 which receives a hinge pin 125 as shown in FIG. 11. Hinge barrel 116 is shown in FIG. 10 and whereas the other barrels have a circular bore 88, hinge barrel 116 has a somewhat oval bore 88C with opposite flattened surfaces. The hinge pin 125 is a straight hinge pin which has a uniform circular cross section along its length. The end of the hinge pin is chamfered or tapered at 126, as seen in FIGS. 9 and 11, to facilitate insertion to the aligned hinge barrels. The chamfered end will also assist in leading the hinge pin into a press fit in the end barrel 116 of the tray. The insertion of the round hinge pin into barrel 116 having an oval opening will provide frictional engagement to retain the hinge pin in place while also facilitating convenient and easy assembly and disassembly of the components.

The tray 34 includes partition walls 150, 152, 154 and 156, which form compartments which may be used to receive items such as nails and screws. The tray also includes annular rings or ridges 162, 164 and 166 which define concentric areas for receiving and stabilizing containers such as paint cans of various sizes such as pints, quarts and gallons. The individual compartments may be provided with magnetic pads 175, as shown in FIG. 1. The magnetic pads are preferably flexible, elastomeric magnets of the type available from various manufacturers, one type being sold under the tradename Magnum Magnetics®. These pads can be cut to size to fit the tray compartments and may be positioned in these compartments and secured by a suitable adhesive if desired. Thus, small, metallic components will be held in place against the magnetic pads. Further, the magnetic pads of this type are resilient and will also provide cushioning when parts are dropped into the compartments by a worker.

Also, as seen in FIG. 1, an organizer drop-in container 180 may be provided. The container 180 has opposite end walls 181, sidewalls 182 and bottom 184. The end walls are configured and spaced-apart to be received within the compartmentalized tray. Suitable partitions 185 may be provided to divide the tray into two or more compartments. A lid 186 may be associated with the container. The lid 186 is shown hinged to the container 180 so that the container 180 may be closed when not in use. Items such as an assortment of nails or screws can be conveniently placed in the various compartments of the container and kept in a workshop or similar location. When the user wishes to use screws, nails or parts in the container, the organizer container 180 can be dropped into the accessory tray as shown in FIG. 1. The size of the tray allows it to be adjustably received within the accessory tray. Preferably, the base of the organizer tray is provided with spaced-apart apertures 183 which align with one or more retention members shown as pins 188 extending upwardly from the bottom of the tray. Thus, the engagement of the alignment pins in the apertures in the container will temporarily secure the container in a stable position in the tray 34.

Figure 12:
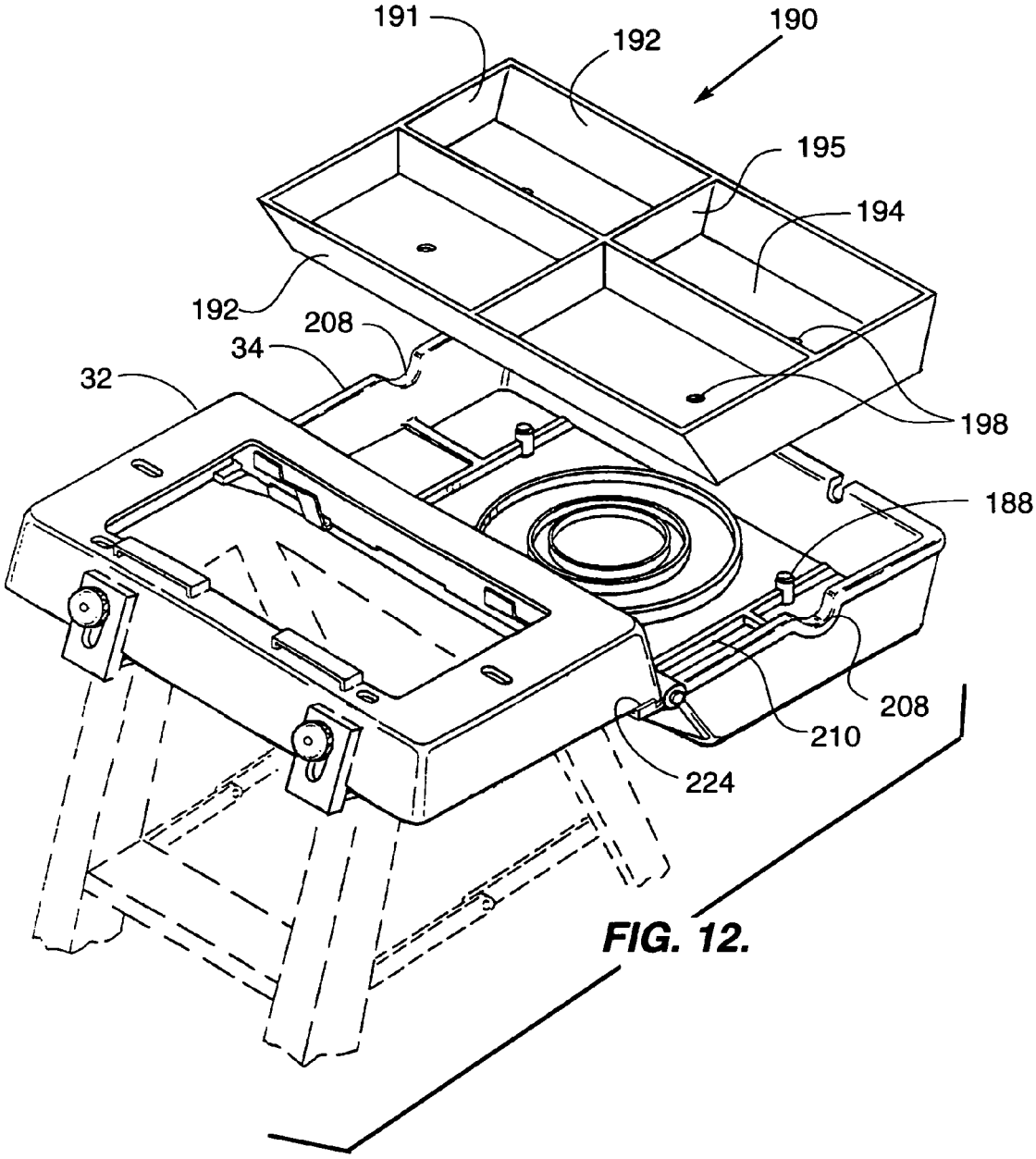
FIG. 12 is a detail perspective view showing the stepladder tray of the present invention with another embodiment of the drop-in organizer tray.
Figure 13:
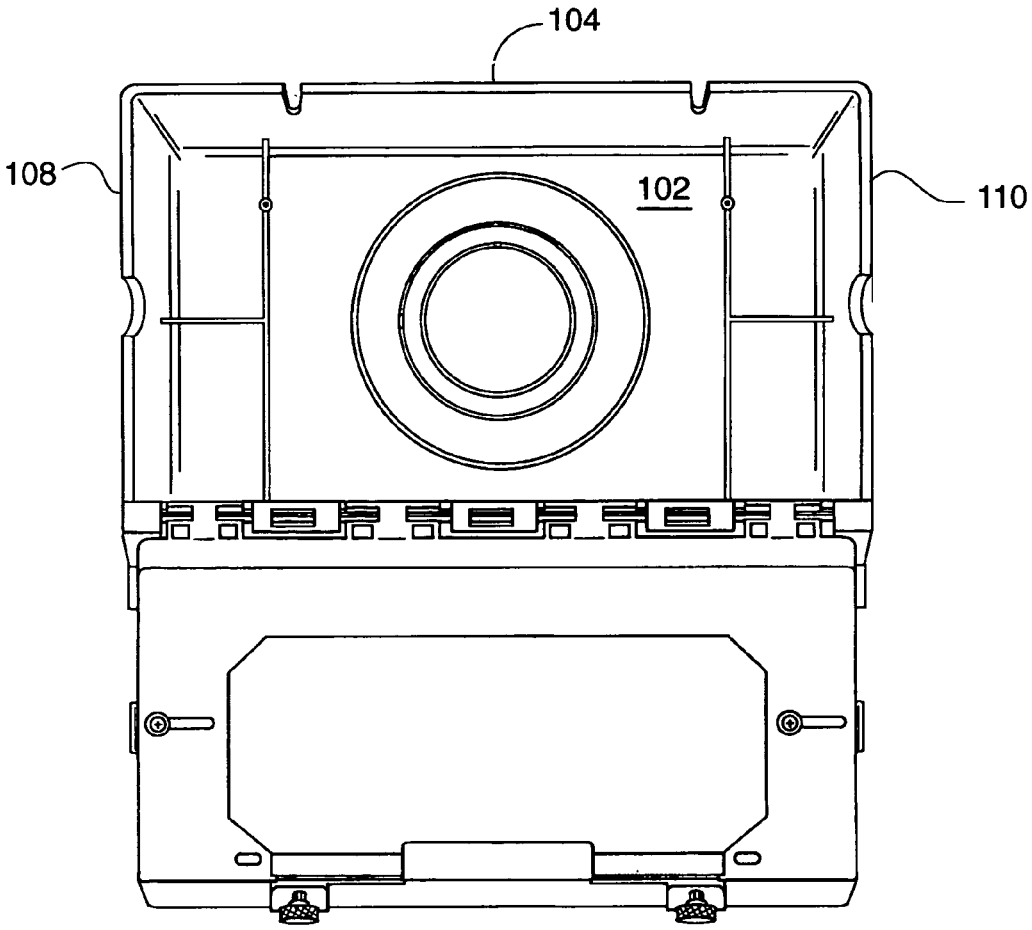
FIG. 13 is a top view of the stepladder tray in an open position.

FIG. 12 shows another embodiment of the organizer container for small parts. Drop-in container tray 190 has opposite ends 191, sidewalls 192 and bottom 194. The container is subdivided into a plurality of compartments by partitions 195. The bottom surface of the container defines bores 198 which are positioned so that they may be placed in alignment and engagement with the retention members 188 projecting upwardly from the bottom of the accessory tray. In the embodiment of FIG. 12, the container 190 is sized to conform to the interior dimensions of the accessory tray 34. In FIG. 1, the container 180 is sized to occupy only a portion of the interior of the accessory tray so that the remaining area is accessible for storage or containment of other items.

For further convenience of the user, the sidewalls 108, 110 of the tray 34 each define arcuate recesses 208 and 210. The arcuate recesses are located at an intermediate location along the upper edge of the sidewalls 108 and 110 and are aligned so tubular items, such as a section of pipe or fluorescent lamp, can be positioned across the recesses and will be retained so it cannot easily roll off the tray.

The front wall 104 of the tray 34 is provided with spaced-apart notches 212 and 214 which are dimensioned to receive a conventional heavy duty electrical cord. The cord may extend to any desired length providing the necessary working length and can then be engaged in one of the recesses which will serve to anchor the cord, preventing it from slipping and becoming taught, which may present a hazard when a power tool is utilized.

Figure 7A:
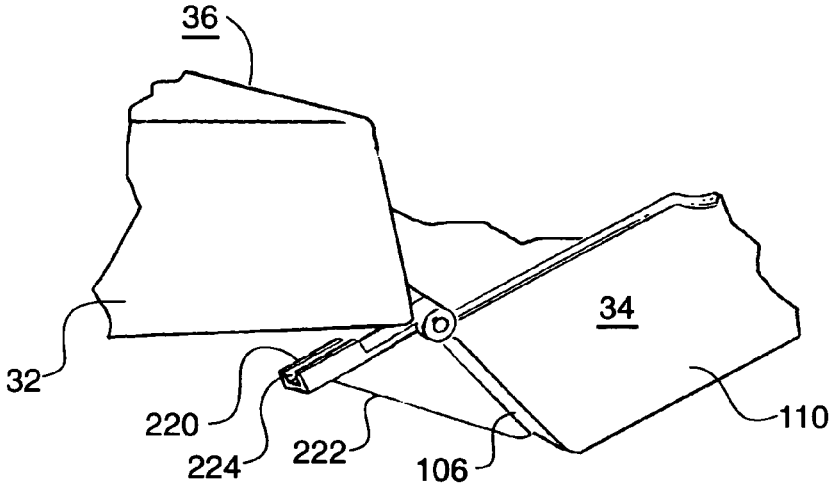
FIG. 7A is a detail view of one of the flanges which supports the tray when deployed.

Referring to FIG. 7A, an opposite pair of flanges 220 extend from wall 106 of the tray 34 at opposite sides of the tray to further stabilize the tray in a deployed position. The flanges align with the lower edge of the walls 108, 110 of the tray and are each reinforced by a gusset plate 222. As seen in FIGS. 1, 7 and 7A, the upper edge of the flanges 220 engage the lower edge of walls 42, 44, respectively, in the deployed position. Preferably the flanges each defines slots 224 in which the base walls seat. The slots, as seen in detail in FIG. 7A, preferably extend angularly with respect to the lower edge of walls 42, 44 so that when the tray is deployed, it is slighting canted or tilted upwardly from horizontal. This angular cant is represented by the angle alpha ($\alpha$) which typically is from about 5°. Thus, when the tray contains heavy items, the material of the tray being plastic may tend to give or yield slightly under load. The angular disposition of the tray accommodates such stress factors so that in a heavily loaded position, the tray will be maintained in a horizontal, or slightly above horizontal, position and the load transferred to the base and ladder top cap.

Additional convenience features may be provided in the form of tabs 234, 236 which are provided on the exterior surface of the base near the rear wall. The tabs each define slot 238 which is dimensioned to receive the portion of the rear U-shaped legs in the conventional paint tray. Thus, the legs of a paint tray T can be engaged in the slots as seen in FIG. 7 to prevent it from slipping.

Figure 14:
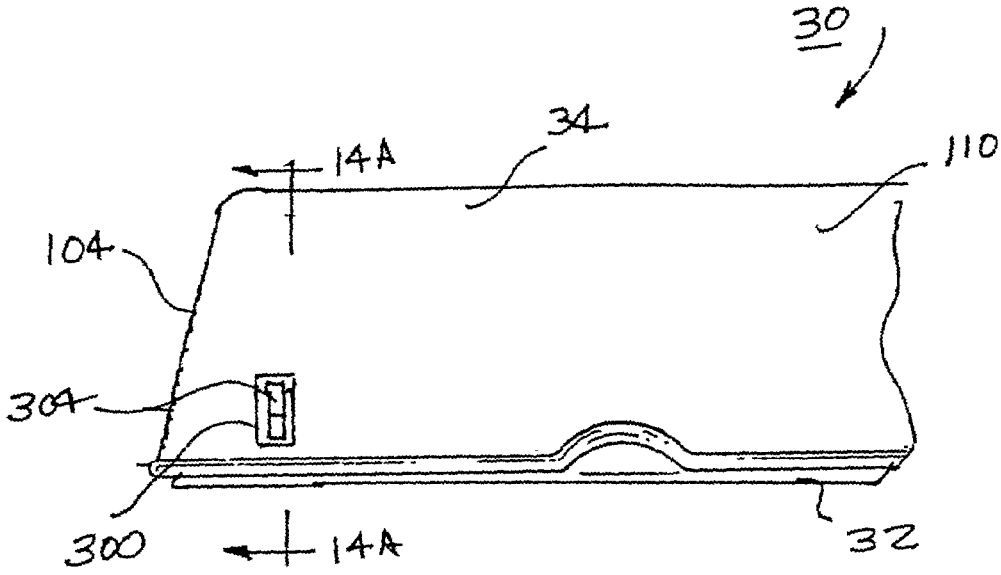
FIGS. 14 and 14A illustrate an embodiment of the invention with a detent for retaining the tray and base in a closed position when not in use.
Figure 14A:
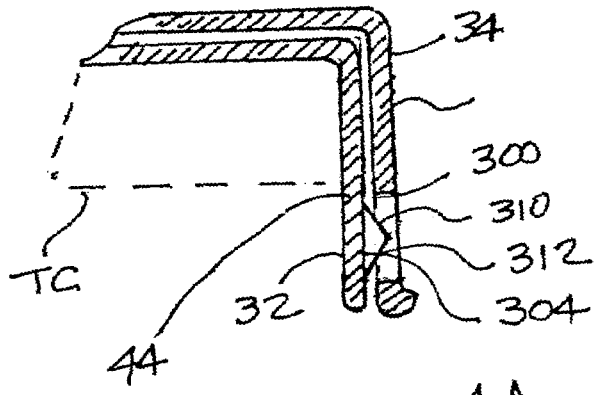

Another convenience feature which may be included is shown in FIGS. 14 and 14A. In many instances, the user will prefer to secure the ladder tray 30 so that it remains affixed to the ladder top cap. This may be done by using fasteners as shown in FIG. 5. When the tray 30 is secured in this manner, it may have a tendency to pivot to the open position when the ladder is carried or transported by the user. Accordingly, as seen in these figures, the base 32 and tray 34 are provided with cooperating retention means to maintain these components in the closed or stored position of FIG. 8 until ready for use.

The retention means comprises a detent having a slot 300 in one or both tray sidewalls 108, 110 located near the intersection with front wall 104. A small projection 304 extends from base sidewalls 42, 44 which, when the base and tray are nested, as seen in FIG. 14, will temporarily maintain the components in this position. When the ladder tray 30 is to be used, the base 32 and tray 34 can be manually separated. The flexibility of the material provides enough "give" to facilitate engaging and disengaging the detent.

The projections 304 are shown as each having a general V-shaped configuration with surfaces 310, 312 sloping at an angle of about 20° to 40°.

The foregoing invention provides an accessory tray which is easily adapted and installed on most conventional stepladders. Once mounted on the ladder, the tray provides an article receptacle for tools, hardware, paint container and small items such as nails and screws. Once the opener deploys, the tray is secured to the ladder top cap by clamps and springs which provide a universal mounting so that it may be adapted to fit most conventional ladders, either of a newer style or older style. While the tray may be made of various materials, it is preferably injection molded from light weight, strong and durable plastic materials representative of which are ABS, polycarbonates, high-impact polystyrenes and similar materials.

In use, the accessory tray is relatively easy to attach the tray to the ladder. The tray can be deployed simply by pivoting the tray forward from the stored position to the use position. When the tray is not in use, loose items are removed and it is pivoted to a position overlying the top cap and the base support so that it does not interfere with the normal use of the stepladder. Magnetic pads in the tray will assist in retaining small metallic items. Accessory items in the form of drop-in organizer trays can also be provided which further add to the versatility and convenience of the tray.

It will be obvious to those skilled in the art to make various changes, alterations and modifications to the invention described herein. To the extent such changes, alterations and modifications do not depart from the spirit and scope of the appended claims, they are intended to be encompassed therein.

We claim:

1. An article-receiving and storage device for use with a ladder having a first pair of front legs, a second pair of step supporting legs and a cap with an upper surface, said article-receiving and storage device comprising:

(a) a base having an interior being dimensioned to receive the top cap of the ladder in an installed position;

(b) a tray having a bottom wall, front wall, rear wall and side walls defining a storage area;

(c) a hinge connecting said base and tray whereby the tray may be pivoted from a stored position with said storage area enveloping at least a portion of said base to a deployed position with said tray extending forwardly from said cap;

(d) one of said tray or base include a support engageable with the other of said tray or base to maintain said tray in an upwardly canted position when deployed without a load; and (e) detent means associated with one of said base or tray for temporarily securing said tray in said stored position.

2. The article-receiving and storage device of claim 1 wherein said hinge connecting said base and tray comprises a plurality of barrels having aligned bores which receive a hinge pin.

3. The article-receiving and storage device of claim 2 wherein one of said barrels defines a non-circular bore and wherein said hinge pin is generally circular in cross-section to establish a frictional fit in said non-circular bore.

4. The article-receiving and storage device of claim 1 including clamp means on said base engageable with said ladder top cap.

5. The article-receiving and storage device of claim 4 wherein said base has a top, front wall, rear wall and opposite sidewalls, said rear wall having a depending tab on its exterior and defining a slot having a recess on the interior side and wherein said clamp means comprises a generally L-shaped body having a threaded stud extending through said bore with a nut engaged therewith.

6. The article-receiving and storage device of claim 5 wherein said clamp is reversibly positionable in said tab slot.

7. The article-receiving and storage device of claim 6 wherein said nut includes a lock washer and a knurled knob.

8. The article-receiving and storage device or claim 1 wherein said tray storage area is partitioned into at least two compartments.

9. The article-receiving and storage device of claim 8 wherein at least one compartment includes a magnetic element.

10. The article-receiving and storage device of claim 1 further including a removable organizer container positionable in one of said smaller compartments.

11. The article-receiving and storage device of claim 1 wherein said detent means comprises a slot defined by one of said tray or base sidewalls and a projection alignable with said slot on the other of said sidewalls.

* * * * *